US010361502B1

(12) United States Patent
Lehnert

(10) Patent No.: US 10,361,502 B1
(45) Date of Patent: Jul. 23, 2019

(54) SOCKET FOR CONNECTING A PLUG CONNECTOR

(71) Applicant: Erich Jaeger GmbH + Co. KG, Friedberg (DE)

(72) Inventor: Lawrence J. Lehnert, Canton, MI (US)

(73) Assignee: Erich Jaeger GmbH + Co. KG, Friedberg (DE)

( * ) Notice: Subject to any disclaimer, the term of this patent is extended or adjusted under 35 U.S.C. 154(b) by 0 days.

(21) Appl. No.: 15/962,995

(22) Filed: Apr. 25, 2018

(51) Int. Cl.
*H01R 13/64* (2006.01)
*H01R 27/00* (2006.01)
*H01R 13/447* (2006.01)

(52) U.S. Cl.
CPC ..... *H01R 13/447* (2013.01); *H01R 13/64* (2013.01); *H01R 27/00* (2013.01); *H01R 2201/26* (2013.01)

(58) Field of Classification Search
CPC ..... H01R 13/447; H01R 13/64; H01R 27/00; H01R 2201/26
See application file for complete search history.

(56) References Cited

U.S. PATENT DOCUMENTS 4,058,358 A * 11/1977 Carlisle ..... H01R 13/447 220/242
4,134,516 A * 1/1979 Sullo ..... H02B 1/066 174/67
4,767,347 A * 8/1988 Kamp ..... H01R 13/64 439/133
4,959,021 A * 9/1990 Byrne ..... H01R 35/02 439/1
5,793,352 A * 8/1998 Greenberg ..... G09G 5/006 345/699
6,447,302 B1 9/2002 Davis
7,331,792 B2 * 2/2008 Cummings ..... H01R 13/5213 439/166
7,524,192 B2 4/2009 Cummings et al.
7,862,352 B2 * 1/2011 Parrish ..... H01R 13/447 439/133
7,967,617 B2 * 6/2011 Vonnegut ..... H01R 13/6658 439/142

* cited by examiner

*Primary Examiner* — Briggitte R. Hammond
(74) *Attorney, Agent, or Firm* — Levy & Grandinetti

(57) ABSTRACT

A socket with two socket portions having a different number of electrical contacts provides ease of handling and securing. A blocking mechanism for blocking the opening of one cover if the other cover is in an opened position can be provided. A socket can be provided that enables this blocking function to be activated and deactivated by a simple reconfiguration of the socket. A socket with 7P and 4P socket portions has a certain number of shared electrical contacts in the 7P and 4P socket portions.

23 Claims, 3 Drawing Sheets

SOCKET FOR CONNECTING A PLUG CONNECTOR

FIELD OF THE INVENTION

A socket for connecting a plug connector in the external area of a motor vehicle is described. The invention is in particular related to a US car electrical socket for trailer towing application.

BACKGROUND OF THE INVENTION

U.S. Pat. No. 7,524,192 B2 describes 7P and 4P sockets in one socket housing with 2 covers fixed with one common axle or hinge pin and a common biasing element (spring) to close both covers. In this embodiment, one cover can only be opened if the other cover is closed. However, it is a disadvantage that the two covers open in different rotation directions. Further, the blocking function of the covers cannot be deactivated if a socket without this blocking function is desired.

In the U.S. Pat. No. 6,447,302 an adapter configured as a master and slave system is described where 7P and 4P sockets are provided in one socket housing with 2 covers. Both covers open in same direction, toward the top, while the hinge pin axles are adjacent. Only the 7P has a bias spring to close cover while the 4P has no spring. Further, no blocking of the covers is provided.

SUMMARY

It is an object of the present invention to provide a socket with two socket portions having a different number of electrical contacts that is easy to handle and secure. It is another object to provide a blocking mechanism for blocking the opening of one cover if the other cover is in an opened position. According to a further object, a socket shall be provided that enables this blocking function to be activated and deactivated by a simple reconfiguration of the socket. It is another object to provide a socket with 7P and 4P socket portions having a certain number of shared electrical contacts in the 7P and 4P socket portions.

The proposed socket for connecting a plug connector in the external area of a motor vehicle has a socket housing; a first plug-receiving opening having a first plurality of first electrical contacts (for example seven), said first plug-receiving opening being formed in the socket housing for plugging-in a first plug connector; a first cover hinge-connected to the socket housing by a hinge pin, said first cover completely sealing off the first plug-receiving opening in its closed position and being spring-loaded in the closing direction; a second plug-receiving opening having a second plurality of second electrical contacts (for example 4), said second plug-receiving opening being formed in the socket housing for plugging-in a second plug connector; a second cover hinge-connected to the socket housing by a hinge pin, said second cover completely sealing off the second plug-receiving opening in its closed position and being spring-loaded in the closing direction; and a blocking mechanism provided at the first cover and the second cover adapted to block opening of one of the first or second covers against plugging-in the first or second plug if the other of the first or second covers is in an opened position for plugging-in the second or first plug; wherein said blocking mechanism comprises a blocking member disposed inside the socket housing and being movable connected to second cover such that it moves during opening and closing of said second cover relative to said second cover guided by a guidance element; wherein the movement of said blocking member is blocked by said blocking member engaging a blocking surface disposed at said first cover if this first cover is in an opened position thereby also blocking opening of said second cover; and wherein opening of said first cover is blocked by said blocking surface engaging said blocking member if said second cover is an opened position with the blocking member moved along the guidance element.

DETAILED DESCRIPTION

Figure 1:
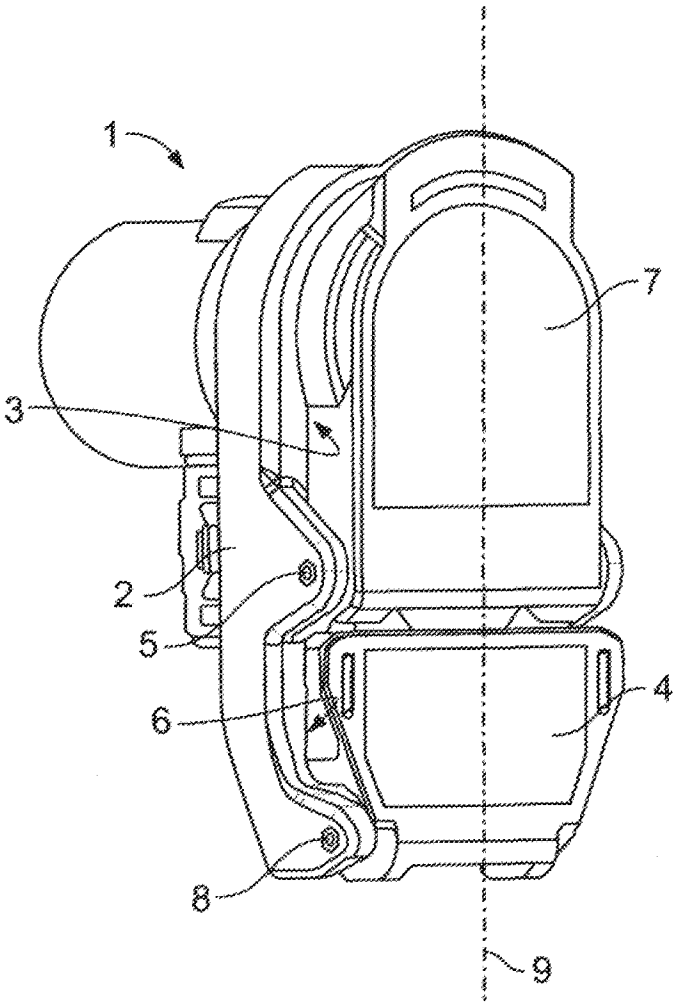
FIG. 1 shows a three-dimensional view of the socket according to an exemplary embodiment of the invention.

FIG. 1 shows an example for a proposed socket 1 usable for connecting a plug connector in the external area of a motor vehicle, having a socket housing 2 formed by injection molding.

In the socket housing 2, a first plug-receiving opening 3 is provided having a first plurality of first electrical contacts (for example seven), said first plug-receiving opening 3 being formed in the socket housing 2 for plugging-in a first plug connector. Thereby electrical connection is produced between the electrical contacts of the first plug-receiving opening 3 and the first plug connector.

A first cover 7 is hinge-connected to the socket housing 2 by a first hinge pin 5, said first cover 7 completely sealing off the first plug-receiving opening 3 in its closed position and being spring-loaded in the closing direction by a first bias spring not shown in the drawings. The first bias spring may be disposed around the first hinge pin 5.

A second plug-receiving opening 6 is provided having a second plurality of second electrical contacts (for example four), said second plug-receiving opening 6 being formed in the socket housing 2 for plugging-in a second plug connector. Thereby electrical connection is produced between the electrical contacts of the second plug-receiving opening 6 and the second plug connector.

A second cover 4 is hinge-connected to the socket housing 2 by a second hinge pin 8, said second cover 4 completely sealing off the second plug-receiving opening 6 in its closed position and being spring-loaded in the closing direction by a second bias spring not shown in the drawings. The second bias spring may be disposed around the second hinge pin 8.

The first cover 7 and the second cover 4 are arranged along a longitudinal length axis 9 extending in the center of the socket 1 along the longer side of the socket housing 2 of the socket 1 one above the other with each of the first and second covers 7, 4 having an individual hinge pin 5, 8. The axle of the hinge pin 5 of the first cover 7 and the axle of the hinge pin 8 of the second cover 4 are directed in parallel to each other, wherein the rotation direction of the first cover 7 and of the second cover 4 around the respective hinge pins 5, 8 is the same for opening of the first cover 7 and opening of the second cover 4. This simplifies the handling for the user as opening of each of the covers can be performed with the same movements. So, the user does not have to concentrate on the question which of the two covers 7, 4 are to be opened. This is in particular useful, as the sockets of this kind are often mounted in areas of the car that are exhausting to reach and access.

As shown in the example of the drawings, the second plug-receiving opening 6 is disposed between the hinge pin 5 of the first cover 7 and the hinge pin 8 of the second cover 4.

The socket shown in FIG. 1 is adapted with a 7P socket portion for example according to SAE J2863 (corresponding to the first plug-receiving opening 3) and with a 4P socket portion for example according to SAE J1239 (corresponding to the second plug-receiving opening 6). However, the correlation may be realized also vice versa.

Figure 2:
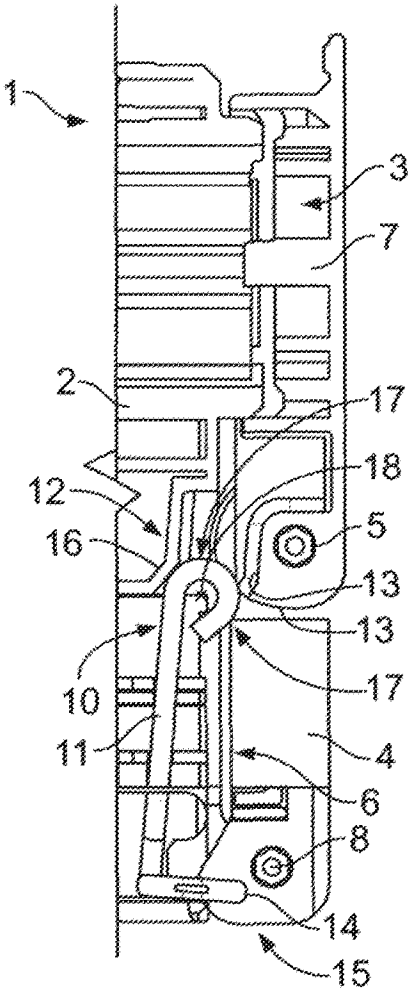
FIG. 2 shows a cut through the socket housing with a cover blocking mechanism for a first and second cover with both covers in a closed position.
Figure 4:
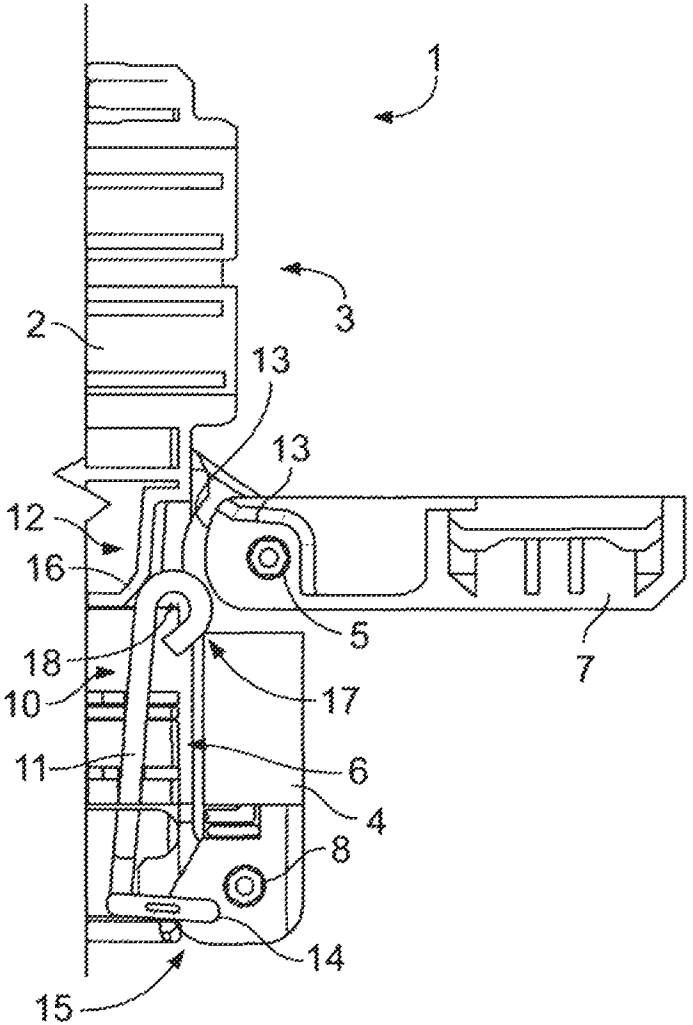
FIG. 4 shows the cut according to FIG. 2 with the first cover in an opened position and the second cover in a closed position.
Figure 3:
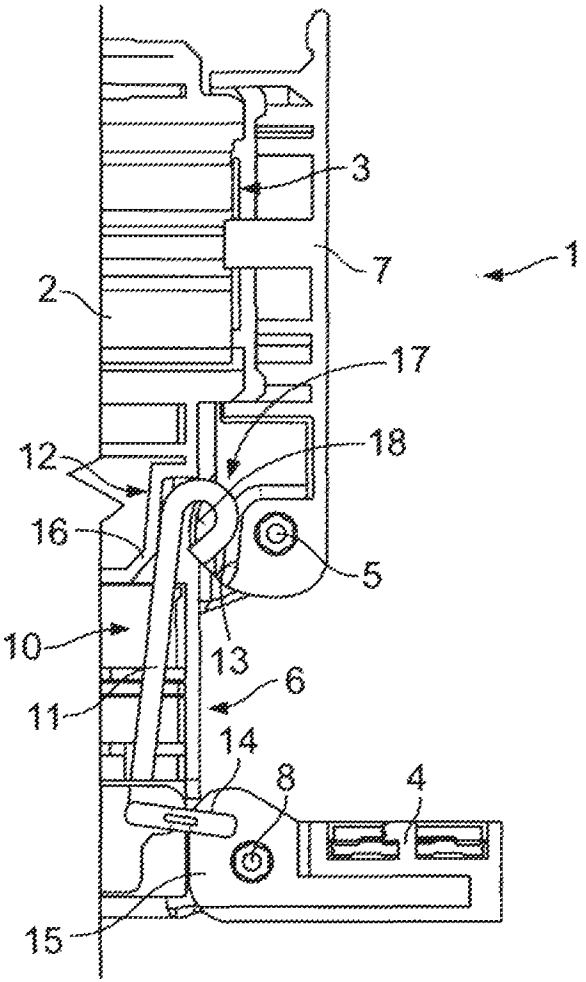
FIG. 3 shows the cut according to FIG. 2 with the first cover in a closed position and the second cover in an opened position.

With respect to the FIGS. 2 to 4, a blocking mechanism 10 of the socket 1 according to the proposal is described more in detail. The blocking mechanism 10 is provided in the socket housing 2 at the first cover 7 and the second cover 4 adapted to block opening of one of the first or second covers 7, 4 against plugging-in the first or second plug if the other of the first or second covers 7, 4 is in an opened position for plugging-in the second or first plug.

The blocking mechanism 10 comprises a blocking member 11 disposed inside the socket housing 2 and being movably connected to the second cover 4 such that it moves during opening and closing of said second cover 4 relative to said second cover 4 guided by a guidance element 12. Movement of said blocking member 11 is blocked by said blocking member 11 engaging a blocking surface 13 disposed at said first cover 7 if this first cover 7 is in an opened position thereby also blocking opening of said second cover 4, to which the blocking member 11 is connected. This situation is shown in FIG. 4.

Further, opening of said first cover 7 is blocked by said blocking surface 13 engaging said blocking member 11 if said second cover 4, to which the blocking member 11 is connected, is an opened position with the blocking member 11 moved along the guidance element 12. This situation is shown in FIG. 3.

In the following, the first plug-receiving opening 3 with the first electrical contacts is also denominated as first socket portion, and the second plug-receiving opening 6 with the second electrical contacts is also denominated as second socket portion.

For clarity reasons only, it is defined that the blocking member 11 is connected to the second cover 4. Accordingly, the blocking surface is provided at the first cover 7. However, this definition shall not be a limitation of the scope of protection, as the arrangement of the first and second cover 7, 4 at the socked housing 2 is not limited to the example shown in the drawings. Also, the number of electrical contacts related to the first and second socket portions might be changed.

Blocking opening the first or second cover 7, 4 does not mean that the respective cover 7, 4 may not be moved at all. Blocking opening of the cover 7, 4 is to be understood such that the cover 7, 4 cannot be opened so far as to allow plugging-in of a plug into the respective plug-receiving openings 3, 6 (socket portion). Partial opening of the cover 7, 4, which does however not allow to plug-in a plug into the socket portion, is also meant as blocking of the cover 7, 4 in the sense described in this text.

The blocking member 11 is pivot-mounted to said second cover 4 in a pivot hole 14 provided in a hinge 15 part of said second cover 4, said pivot hole 14 being spaced in radial direction from the hinge pin 8 of the second cover 4.

The hinge part 15 of the second cover 4 is a plane directed perpendicular to the axle of the hinge pin 8 surrounding the hinge pin 8 for fixing the cover 4 to the socket housing 2. Typically, there may be provided two hinge parts 15 at each of the first and second covers 7, 4, one at each side of the cover 7, 4 along the hinge pin 5, 8.

Thus, if the second cover 4 is opened by rotation around the hinge pin axle 8, also the pivot hole 14 in the hinge part 15 rotates around the hinge pin axle 8 thereby moving the blocking member 11 in the guidance element 12. The pivot hole 14 is disposed such in the hinge part 15 that the pivot hole 14 moves toward the first cover 7 during rotation of the second cover 4 to open the second cover 4. This can be realized, as shown in the drawings, by disposing the pivot hole 14 in a zone of the hinge part 15 between the hinge pin 8 and the socket housing 2.

According to one proposal, the pivot hole 14 may also be disposed on the side of the hinge pin 8 opposite to the first cover 7, i.e. in FIG. 2 towards to lower end of the socket 1.

In the example shown, the blocking member 11 has at its end directed towards the first cover 7 a rounded loop 17 or differently shaped surface (also denominated as rounded loop in the following and in the claims) for engagement with the blocking surface 13 of the first cover 7.

The rounded form of the rounded loop 17 has the advantage that the blocking members 11 slides well during its movement along the guidance element 12 and/or the blocking surface 13 of the first cover 7, at least if no blocking occurs due to the first cover 7 being in a closed position as shown in FIGS. 2 and 3. When the second cover 4 is in an opened position, as shown in FIG. 3, the rounded loop 17 of the blocking member 11 is positioned between the hinge pin 5 of the first cover 7 and the guidance element 12 with the center 18 of the rounded loop 17 being positioned farther from hinge pin 8 of the second cover 4, to which the blocking member 11 is connected, than the hinge pin 5 of the first cover 7 is. In other words, the distance between the hinge pin 8 of the second cover 4 and the center 18 of the rounded loop 17 is larger than the distance between the hinge pin 8 of the second cover 4 and the hinge pin 5 of the first cover 7.

With the rounded loop 17 positioned such, the first cover 7 is prevented from being opened in a very safe manner if the second cover 4 is in the opened position. During trial of opening the first cover 7, the blocking surface 13 of the first cover 7 will abut against the rounded loop 17, and the rounded loop 17 will be pushed by engagement of the blocking surface 13 further away from the second cover 4 along the guidance element 12. It will thus not be moved back in a position leading to a release of the blocking of the first cover 7 to be opened. This is evident from FIG. 3.

Thus is due to the technical effect that the rounded loop 17 of the blocking member 11 is positioned between the hinge pin 5 of the first cover 7 and the guidance element 12 such that during a trial opening the first cover 7 a resulting force of the blocking surface 13 on the rounded loop 17 is (due to engagement) directed away from the second cover 4, to which the blocking member 11 is connected. Thus, the blocking function of the blocking mechanism 10 is still enforced in case of a trial opening the first cover 7 with the second cover 4 already being in an opened position.

In line with an embodiment of the proposal, the guidance element 12 may comprise a ramp 16 or other guide (also denominated as ramp in the following and in the claims), as shown in FIG. 2. The end of the blocking member 11 directed towards the first cover 7 is seated on this ramp 16 when the second cover 4, to which the blocking member 11 is connected, is in a closed position. The closed position of the second cover 4 is shown in both FIGS. 2 and 4.

The ramp 16 is directed such that during movement of the of the second cover 4, to which the blocking member 11 is connected, the blocking member 11 is guided closer towards the hinge pin 5 of the first cover 7, having a smaller distance to the hinge pin 5 than before, i.e. with the second cover 4 in the closed position. This is evident from a comparison of the FIGS. 3 and 4.

Such movement is only possible when the first cover 7 is closed, as shown in FIGS. 2 and 3. The space between the guidance element 12 and the blocking surface 13 of the first cover 7 is in line with the proposal (and if the first cover 7 is in a closed position) just such that the end of the blocking member, in particular the rounded loop 17, can be moved along the guidance element 12 with the opposite site of the rounded loop 17 sliding along the blocking surface 13 of the first cover (see in particular FIG. 3).

If in such position of the rounded loop 17 (as shown in FIG. 3) it is tried to open the first cover 7, the blocking surface 13 abuts against the rounded loop 17 of the blocking member 11, or more generally against the blocking member 11. Thereby, opening of the first cover 7 is reliably blocked in the sense that the first cover 7 cannot be opened as far as to allow plugging-in of a plug into first plug-receiving opening 3 (first socket portion).

When, however, the second cover 4 is in the closed position, the rounded loop 17 of the blocking member 11 is positioned on the ramp 16 of the guidance element 12 with the center 18 of the rounded loop 17 being positioned closer to the hinge pin 8 of the second cover 4 (to which the blocking member 11 is connected) than the hinge pin 5 of the first cover 7 is. In other words, the distance between the hinge pin 8 of the second cover 4 and the center 18 of the rounded loop 17 is smaller than the distance between the hinge pin 8 of the second cover 4 and the hinge pin 5 of the first cover 7.

If the first cover 7 is in an opened position while the second cover is in a closed position and the rounded loop 17 is seated on the ramp 16, the blocking surface 13 of the first cover 7 engages the rounded loop 17 positioned on the ramp 16. Thereby, blocking surface 13 of the first cover 7 exerts a resulting force on the blocking member 11 jamming the rounded loop 17 of the blocking member 11 on the ramp 16.

This resulting force prevents the rounded loop 17 and the blocking member 11 from moving along the ramp 16 and the guidance element 12. As such movement would inevitably occur while the second cover 4 is opened, the second cover 4 cannot be opened for plugging-in a plug into the second plug-receiving opening 6 (second socket portion) while the first cover 7 is in an opened position jamming the rounded loop 17 on the ramp 16.

In line with the proposal, the blocking member 11 may be formed as at least one push-rod, as shown in the Figures.

There may also be proposed two push-rods as blocking member 11, one connected at each of the two hinge parts 15 of the second cover 4. The advantage of two push-rods in the blocking member 11 is that blocking of the respective other cover 7, 4, depending on the first cover 7 or second cover 4 being in the opened position, is symmetrical with respect to the longitudinal length axis 9 extending in the center of the socket 1 (which may coincide with the middle axis of the covers 4, 7), the axis 9 being directed perpendicularly to the hinge pin axles 5, 8. The embodiment shown in the drawings has only one push-rod as blocking member 11, however the blocking member 11 of the proposed socket may comprise two or even more elements, such as the push-rods.

In the following, the term "push-rod" is also used synonym with the term "blocking member". The push-rod may be formed by a metal bar, such as a steel bar which is bent in a suited manner.

The push-rod shown in the Figures by way of example for a blocking member 11 according to the proposal is formed by a straight bar with one end bent to the rounded loop 17 and the other end bent to engage the pivot hole 14 in the second cover 4.

In this embodiment of the proposal, the blocking member 11 is a technical simple but effective and reliable element.

It is a further advantage of the proposal according to the invention that the socket 1 with the first socket portion for plugging-in a first plug and the second socket portion for plugging-in a second plug is fully operational also without the blocking member 11 (push-rod) that may be left out during mounting of the socket 1. All other components of the blocking mechanism 10, including the ramp 16, the guidance element 12, the pivot hole 14 and free space in the socket housing 2 for inserting the blocking member 11 are provided nevertheless in the socket housing 2. Accordingly, the function of the socket 1 (with or without blocking the opening of the one cover 7, 4 if the other cover 7, 4 is in an open position) can be realized with the identical socket housing 2. Typically, the socket housing 2 is produced by molding. The molding process is identical for both sockets (with or without the blocking function).

According to a further aspect of the proposal, the first plug-receiving opening 3 and the second plug-receiving opening 6 have a number of shared (electrical) contacts 21A, 21B, 21C, 21D (for example four common electrical contacts). Each of the shared contacts 21A, 21B, 21C, 21D in the first plug-receiving opening 3 and the second plug-receiving opening 6 are electrically connected with each other but electrically isolated to the other shared contacts 21A, 21B, 21C, 21D. This is shown in FIG. 6.

This means that the electrical circuits between the two socket portions, in the example the 7P and the 4P socket portions, are shared by the shared contacts 21A, 21B, 21C, 21D, with the consequence that each of the shared contacts 21A, 21B, 21C, 21D in the 7P and the 4P socket portions are supplied with the same signals at the same time. Accordingly, each shared contact 21A, 21B, 21C, 21D carries the identical reference numeral in the both socket portions as they are physically one part each.

The shared contacts 21A, 21B, 21C, 21D are connected by busbars 22A, 22B, 22C, 220 which reside each in the same first plane 23 for first plug-receiving 3 opening and in the same second plane 24 for first plug-receiving opening 6. The different planes 23, 24 are better visible in FIG. 5.

Figure 6:
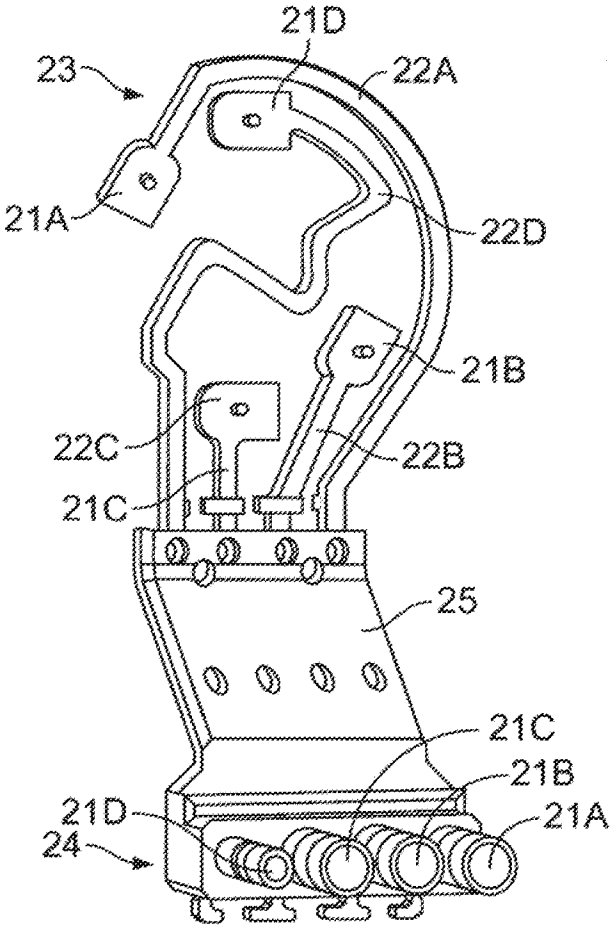
FIG. 6 shows the busbar configuration in a preliminary injection over-mold with the shared electrical contacts hold isolated against each other.

In FIG. 6, the busbars 22A, 22B, 22C, 22D are partially contained in one preliminary injection over-mold 25 in which the busbars 22A. 22B. 22C, 220 for each of the shared electrical contacts 21A, 21B, 21C, 21D and hold isolated against each other.

Figure 5:
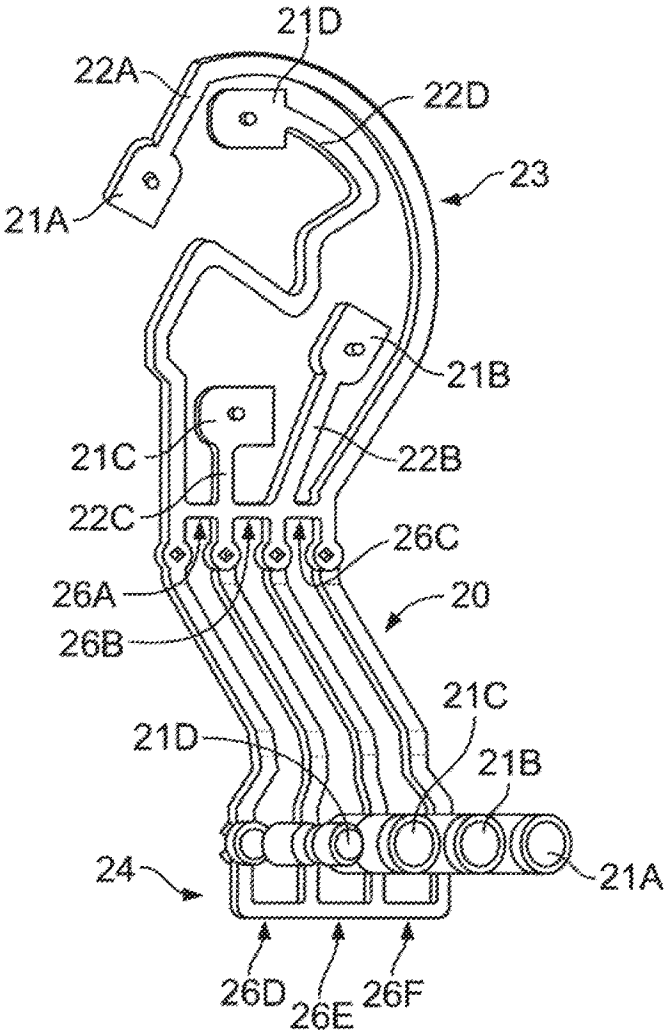
FIG. 5 shows a single part busbar configuration used for production of the socket housing in a step with all busbars electrically connected to each other.

However, as evident from FIG. 5, all busbars 22A, 22B, 22C, 220 are initially created as one single busbar part 20, in which all busbars 22A, 22B, 22C, 22D are electrically connected with each other, wherein this single busbar part 20 is over-molded to form the preliminary injection over-mold 25 and wherein the busbars 22A, 22B, 22C, 22D of the different shared electrical contacts 21A, 21B, 21C, 21D are cut apart into separate circuits after the preliminary injection over-mold 25 was molded. Cutting apart occurs at the positions indicated by the arrows of the busbar connecting bridges 26A, 26B, 26C, 26D, 26E, 26F.

In FIG. 6, the busbars 22A, 22B, 220, 22D are cut apart at the positions indicated by the reference numerals 26A, 26B, 26C, 26D, 26E, 26F in FIG. 5.

In a final production step of the socket 1, the preliminary injection over-mold 25 is over-molded for building the entire socket-housing 2.

Summarizing important features of the electrical socket 1 for connecting a plug connector in the external area of a motor vehicle, 7P- and 4P-socket portions (first and second plug-receiving opening 3, 6) are provided in one socket housing 2 using two covers 7, 4 both opening in same direction, with each having a separate hinge pin 5, 8 (axle) and a separate bias spring to close. The hinge pins 5, 8 are not adjacent, but arranged one over the other. A special developed push-rod as blocking member 11 of a proposed blocking mechanism restricts the opening of two covers 7, 4 concurrently.

The first 7P-socket portion has seven terminals (electrical contacts) and the second 7P-socket portion has four terminals (electrical contacts) within one plug-receiving opening 3, 6, each of the plug-receiving openings 3, 6 having a cover 7, 4. Both covers 7, 4 open in the same direction, and each cover 7, 4 has a separate hinge pin 5, 8 and a separate bias spring to keep the cover 7, 4 closed if the respective socket portion is not in use. The cover hinge pins 5, 8 are oriented one over the other, not adjacent.

Only one cover 7, 4 can be opened to utilize its related socket portion intended function at any given time due to a push-rod or blocking mechanism 10 which restricts utilization to one single socket portion at any time. However, by simply leaving out the blocking element 11 (push-rod) of the blocking mechanism 10 during mounting of the socket 1, the socket 1 can also be used without this blocking function.

As blocking member 11, a single push-rod or two push-rods may be utilized. The (or each) push-rod 11 is connected to the second cover 4 via a pivot hole 14 near the hinge pin 8. The other end of the push-rod is guided by a ramp 16 of a guidance element 12 in the socket housing 2 to restrict the first cover 7 from opening when the second cover 4 is open. When opening the second cover 4, the push-rod 11 utilizes the cam action created by the pivot hole 14 and hinge pin 8 to move the push-rod 11 through the guidance element 12 in the socket housing 2 to interfere with the opening of the first cover 7 by engagement with its blocking surface 13.

Electrical circuits are shared between the two socket portions using busbars 22A, 22B, 22C, 22D which all reside in the same geometric plane and carry electric current between the two socket portions. The busbars 22A, 22B, 22C, 22D are created as a single busbar part 20 before the 4P-terminal contacts are installed along with rivets to connect the 7P terminal contacts, prior to a preliminary injection over-mold for forming the preliminary injection over-mold 25, and then the busbars 22A, 22B, 22C, 22D are cut apart into separate circuits before the final socket housing 2 is over-molded.

What is claimed is:

1. A socket for connecting a plug connector in the external area of a motor vehicle, said socket comprising:

a socket housing;

a first plug-receiving opening having a first plurality of first electrical contacts, said first plug-receiving opening being formed in the socket housing for plugging-in a first plug connector;

a first cover hinge-connected to the socket housing by a hinge pin, said first cover completely sealing off the first plug-receiving opening in a closed position of said first cover and being spring-loaded in a direction towards the closed position;

a second plug-receiving opening having a second plurality of second electrical contacts, said second plug-receiving opening being formed in the socket housing for plugging-in a second plug connector;

a second cover hinge-connected to the socket housing by a hinge pin, said second cover completely sealing off the second plug-receiving opening in a closed position of said second cover and being spring-loaded in a direction towards the closed position; and a blocking mechanism provided at the first cover and the second cover adapted to block opening of one of the first or second covers against plugging-in the first or second plug if the other of the first or second covers is in an opened position for plugging-in the second or first plug;

wherein said blocking mechanism comprises a blocking member being disposed inside the socket housing and movably connected to the second cover such that said blocking member moves during opening and closing of said second cover relative to said second cover guided by a guidance element;

wherein the movement of said blocking member is blocked by said blocking member engaging a blocking surface disposed at said first cover if this first cover is in an opened position thereby also blocking opening of said second cover; and wherein opening of said first cover is blocked by said blocking surface engaging said blocking member if said second cover is an opened position with the blocking member moved along the guidance element.

2. The socket according to claim 1 wherein said blocking member is pivot-mounted to said second cover in a pivot hole provided in a hinge part of said second cover, said pivot hole being spaced in radial direction from the hinge pin of said second cover.

3. The socket according to claim 1 wherein said blocking member has a rounded loop or differently shaped surface for engagement with the blocking surface of said first cover at its end directed towards the first cover.

4. The socket according to claim 3, wherein rounded loop of the blocking member is positioned between the hinge pin of the first cover and the guidance element with the center of the rounded loop being positioned farther from the hinge pin of the second cover than the hinge pin of the first cover is, when the second cover is in an opened position.

5. The socket according to claim 3, wherein rounded loop of the blocking member is positioned between the hinge pin of the first cover and the guidance element such that, during a trial of opening the first cover, a resulting force of the blocking surface on the rounded loop is directed away from the second cover.

6. The socket according to claim 1, wherein said guidance element comprises a ramp or other guide on which the end of the blocking member directed towards the first cover is seated when the second cover is in a closed position.

7. The socket according to claim 6, wherein the ramp is directed such that during movement of the of the second cover the blocking member is guided closer towards the hinge pin of the first cover, having a smaller distance to the hinge pin than before with the second cover in the closed position.

8. The socket according to claim 3, wherein the rounded loop of the blocking member is positioned on the ramp of the guidance element with the center of the rounded loop being positioned closer the hinge pin of the second cover than the hinge pin of the first cover is, when the second cover is in the closed position.

9. The socket according to claim 8, wherein the blocking surface engages the rounded loop positioned on the ramp when the first cover is in the open position, thereby exerting a resulting force jamming the rounded loop on the ramp.

10. The socket according to claim 1 wherein said blocking member is formed as at least one push-rod.

11. The socket according to claim 10 wherein the push-rod is formed by a straight bar with one end bent to the rounded loop and the other end bent to engage the pivot hole in the second cover.

12. The socket according to claim 1 wherein the first cover and the second cover are arranged along a longitudinal length axis of the socket one above the other with each of the first and second cover having an individual hinge pin.

13. The socket according to claim 1 wherein the axle of the hinge pin of the first cover and the axle of the hinge pin of the second cover are directed parallel to each other.

14. The socket according to claim 13 wherein the rotation direction of the first cover and the rotation direction of the first cover of the second cover around the respective hinge pins are the same for opening of the first and second cover.

15. The socket according to claim 1 wherein the first plug-receiving opening or the second plug-receiving opening is disposed between the hinge pin of the first cover and the hinge pin of the second cover.

16. The socket according to claim 1 wherein socket is adapted with a 7P socket portion and with a 4P socket portion, said 7P socket portion being realized with one of the first or second plug-receiving opening and said 4P socket portion being realized with the other of the first or second plug-receiving opening.

17. The socket according to claim 1 wherein said first plug-receiving opening and said second plug-receiving opening have a number of shared contacts, each of shared contacts in the first plug-receiving opening and the second plug-receiving opening being electrically connected with each other.

18. The socket according to claim 17 wherein the shared contacts are connected by busbars which reside each in the same first plane for the first plug-receiving opening and in the same second plane for the second plug-receiving opening.

19. The socket according to claim 18 wherein the busbars are contained in one preliminary injection over-mold in which the busbars for each of the shared electrical contacts are hold isolated against each other.

20. The socket according to claim 19 wherein the all busbars are initially created as one single busbar part, in which all busbars are electrically connected with each other, wherein this single busbar part is over-molded to form the preliminary injection over-mold and wherein the busbars of the different shared electrical contacts are cut apart into separate circuits after the preliminary injection over-mold was molded.

21. The socket according to claim 19 wherein the preliminary injection over-mold is over-molded for forming the socket housing.

22. The socket according to claim 6, wherein the rounded loop of the blocking member is positioned on the ramp of the guidance element with the center of the rounded loop being positioned closer the hinge pin of the second cover than the hinge pin of the first cover is, when the second cover is in the closed position.

23. The socket according to claim 22, wherein the blocking surface engages the rounded loop positioned on the ramp when the first cover is in the open position, thereby exerting a resulting force jamming the rounded loop on the ramp.

* * * * *